United States Patent [19]

Zern

[11] 4,170,955

[45] Oct. 16, 1979

[54] DANGER ALARM DEVICE

[76] Inventor: Gordon K. Zern, Box 74, Hungerford Rd., Briarcliff Manor, N.Y. 10510

[21] Appl. No.: 959,415

[22] Filed: Nov. 13, 1978

[51] Int. Cl.[2] ..... G08B 3/06

[52] U.S. Cl. ..... 116/67 R; 116/137 R

[58] Field of Search ..... 116/142 FP, 140, 112, 116/137 R, 147, DIG. 44, 67 R; 251/349, 351, 353, 100; 222/402.25, 402.1, 402.17

[56] References Cited

U.S. PATENT DOCUMENTS

| | | | |
|---|---|---|---|
| 3,670,690 | 6/1972 | Swanson | 116/112 |
| 3,785,335 | 1/1974 | Wagner | 116/142 R |
| 3,918,437 | 11/1975 | Saba | 251/353 |
| 4,044,712 | 8/1977 | Goodman | 116/112 |

*Primary Examiner*—S. Clement Swisher
*Assistant Examiner*—Denis E. Corr
*Attorney, Agent, or Firm*—Lackenbach, Lilling & Siegel

[57] ABSTRACT

This invention has to do with an alarm used by persons engaged in high-risk activities. A can of propellant gas is used in combination with a means to generate a noise signal at approximately 120 decibels. A rotatable shaft is used to connect the pressurized container and the noise generating means during operation of the device. A flutter valve can be used in the noise generating means to produce an intermittent signal.

10 Claims, 8 Drawing Figures

DANGER ALARM DEVICE

FIELD OF THE INVENTION

This invention has to do with an alarm used by persons engaged in high-risk activities. More specifically, the disclosed alarm is basically designed for use by firemen and persons engaged in similar activities. The object of the invention is to provide endangered personnel with a simple to operate alarm that will be effective to alert others of the users' predicament.

BACKGROUND OF THE INVENTION

Generally, in high-risk occupations, the personnel will work in groups of at least two. However, oftentimes these groups become separated and individuals are left to their own devices. In the case of firemen, this can often happen in smoke-filled buildings. Thus, all too frequently, a firemen may find himself in a smoke-filled building alone and unable to determine how to escape from danger. Such a delicate situation can be compounded by the fireman's air pack running low on air. Also, it is quite possible that the fireman has with him an injured companion or an injured victim of the fire. In such a case, while he may know the way to escape, he might not be able to escape with his injured companion or with the victim. In such cases, it is extremely important that the fireman have some means by which he can notify fellow firemen that he needs assistance.

SUMMARY OF THE INVENTION

Therefore, it is an object of this invention to provide a device by which firemen, or personnel operating in similar high-risk occupations, can alert other firemen to their situation so that they may be assisted.

A main requirement of such an alarm must necessarily be that it emit a clear, audible and distinctive noise. At fires, there are noises from various sources. For instance, there are the crackling noises of the flames, the hissing sounds of the hoses, the sputtering of steam, sirens, voices, traffic, and interference from radios and alarms. The alarm used by each of the firemen must be capable of piercing through this veil of noise with a recognizable sound. This object is attained by the disclosed invention by the use of an intermittent siren or alarm. Moreover, the intermittent signal used by the device is, and must be, readily distinguishable from the sirens, wailers, yelps, hi-los, or other alarms indigenous to fire equipment and ambulances. If the signal is sufficiently distinguishable from the other noises at a fire, it is possible to provide a continuously sounding signal.

The device in question must be readily accessible to the user, thus it is suggested that it be worn on the garments of the user. A possible location for the device would be on the interior flap of the turn-out coat, which is usually worn by firemen.

Another even more important requirement of the device is that it not be capable of accidental activation. Thus, the invention is designed so that it can only be activated by a fireman who intends to activate it.

Inasmuch as the device is to be worn in high-risk areas, such as fires, it must be a device that will not be set off by heat, water, dampness or ice. If this was so, the device would often be sounding and would be of little value. Because of the unique manner in which the invention is activated, it is not possible for it to be set off by heat, water, dampness or ice.

In these extreme high-risk occupations, frequently one in need of assistance will have at most one hand to sound an alarm. Thus, the disclosed invention is capable of activation by the user with only one hand. However, this object is attained without any sacrifice as to the strength and sturdiness of the device. For instance, the device, as it must be, is not affected by jars, normal impacts, or bumps by tools or against ladders. This is most important as it may be quite difficult for firemen to operate without receiving some type of jar or shock.

Another important object is to provide the device in a shape that will not prove harmful to the user. What is meant by this is that the device should have no sharp edges or corners that could injure the firemen upon his falling on top of it.

Basically, the invention includes a can of propellant gas in combination with a means to emit an intermittent signal at about 120 decibels. Such a signal is at about the maximum noise level that the human ear can tolerate. In fact, it is quite possible that the sound emitted by the alarm can cause temporary deafness. By means of a flutter valve the signal emitted by the alarm is made intermittent.

DETAILED DESCRIPTION OF THE INVENTION

Figure 1:
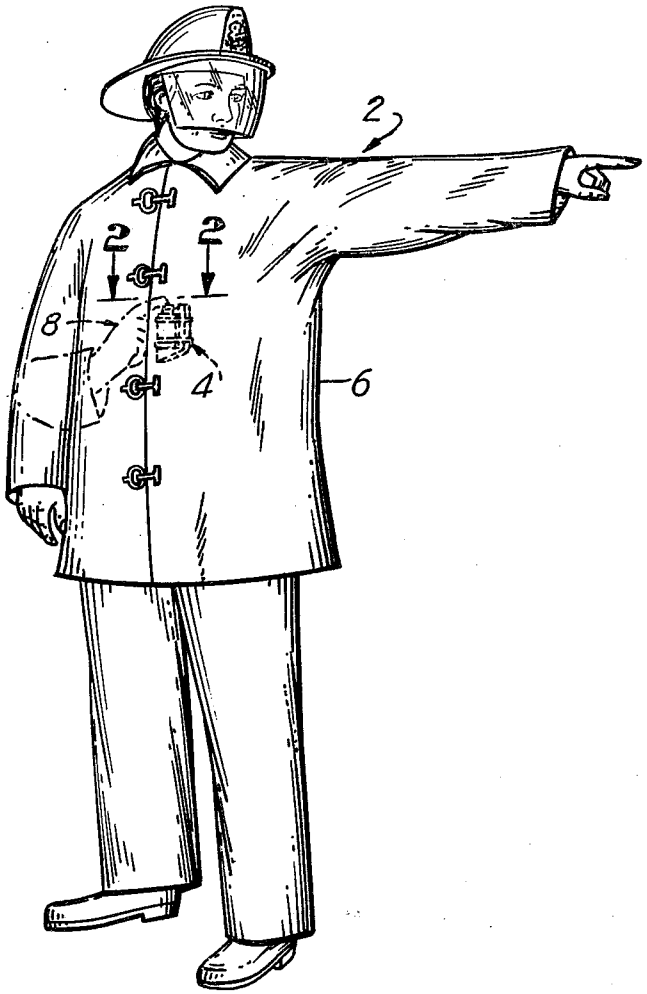
FIG. 1 is a view of the device mounted on a user, in this case a fireman.
Figure 8:
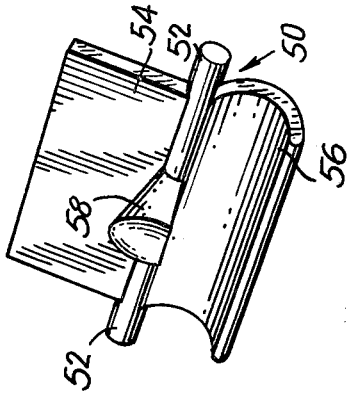
FIG. 8 is a perspective view of the flutter valve of this invention.

As can be seen in FIG. 1, the user 2 of the alarm 4 can position it on his garments. In this case, the alarm 4 is attached to the inside flap of the fireman's coat 6. This can be done in any number of ways. For instance, it is possible that a specially designed pocket can be sewn into the coat for the alarm. Also, it is possible to provide some type of snaps on the device which will mate with snaps on the inside flap of the coat. Other suitable methods for connecting the alarm to the coat or other garment are readily apparent. The important thing is that whatever means is used should be one that will provide a reliable binding of the alarm to the garment, so that it will not detach and possibly become lost by the user.

Figure 3:
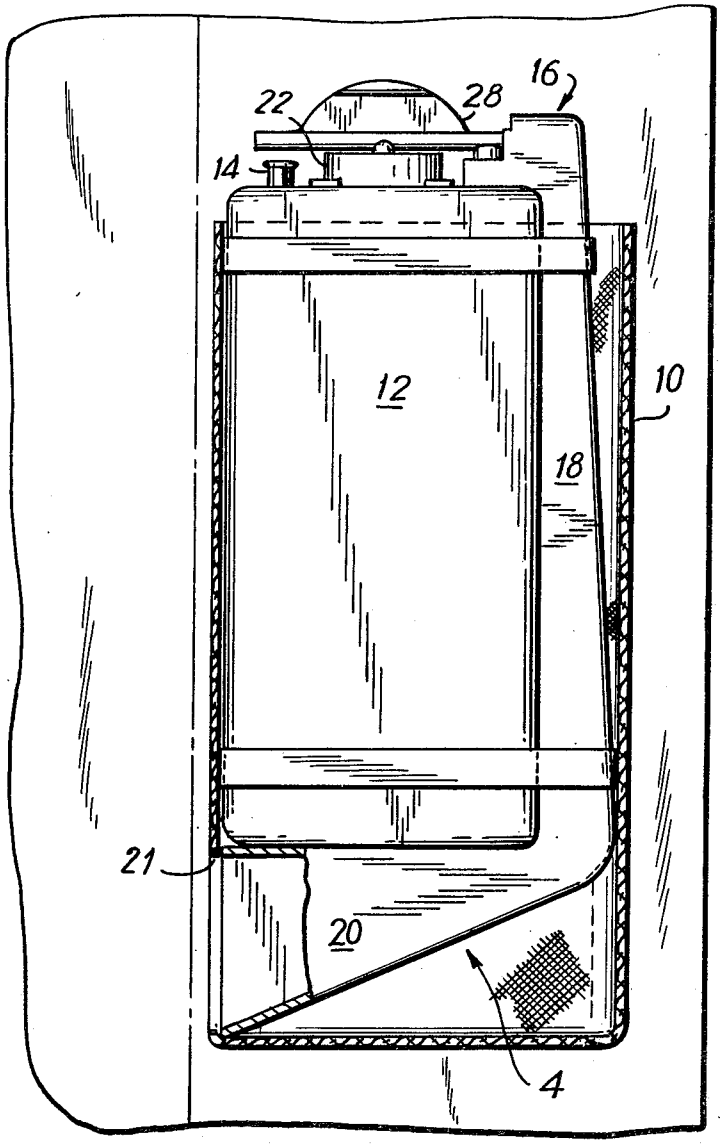
FIG. 3 is a front elevational view taken along the line 3—3 of FIG. 2.
Figure 2:
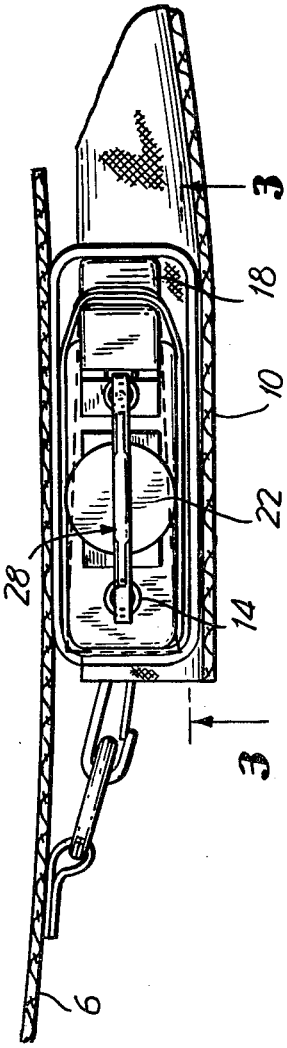
FIG. 2 is a top plan view along the line 2—2 of FIG. 1.

As can be seen from FIGS. 2 and 3, a fabric sleeve 10 or sheath is suitably attached to the outer garment as a holder for the alarm. Included with the alarm is a can or container 12 of pressurized gas. An activation nozzle 14, such as is used on aerosol cans, is provided on the top portion of the container 12. The construction of the container 12 and the activation nozzle 14 is the same as is used on conventional aerosol cans. As for the pressurized gas provided in the container 12, it may be any gas which is suitable for use with a gas-operated horn or siren system.

Suitably connected to the pressurized container 12 is a horn or noise producing system 16. The resonant chamber 18 of the horn producing system 16 is positioned along one side of the container 12. Attached to the bottom portion of the resonant chamber 18 is a sound-emitting bell-shaped or trumpet portion 20. The trumpet portion 20 preferably curves in underneath the container 12. The sleeve or holder 10 should have an opening 21 in alignment with the opening of the trumpet portion 20, to facilitate noise emission.

Included in the top portion of the container 12, preferably in a central location, is a housing 22. A plate 24 with an upwardly extending rod 26 is positioned inside of the housing 22. The upper end of the rod 26 passes through a central opening 23 in a top part 25 of the housing 22 and is operatively associated with a grip 28. The grip 28 may be made integral with the rod 26 and plate 24. Intermediate the bottom surface 31 of the grip 28 and the top portion of the rod 26 is a longitudinally extending shaft 30 having an internal channel 32. The purpose of this channel, as will be explained later, is that it transmits the gas from the pressurized container 12 to the noise producing system 16.

The shaft 30 terminates at one end with a short right angle extension 34. The internal channel 32 is coextensive with and conforming to the shape of the shaft, thus providing a right angled passageway. In its non-operational position, see FIG. 4, the extension 34 rests in a recess 36 of a built up shoulder 38 positioned on the opposite end surface of the top of the pressurized container 12 from the position at which the activation nozzle 14 is positioned. Further, this shoulder 38 should be abutting against the upper portion or resonance cavity 40 of the resonant chamber 18.

Figure 5:
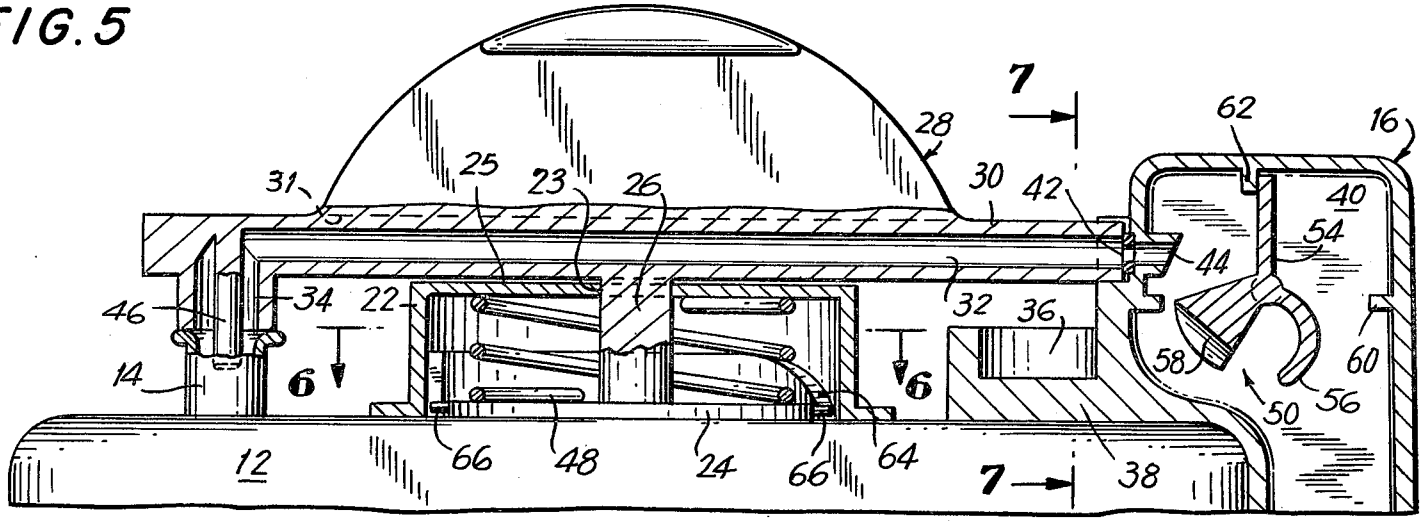
FIG. 5 is an enlarged fragmentary, elevational view, partly in section, of the upper portion of the device in an operating condition.
Figure 7:
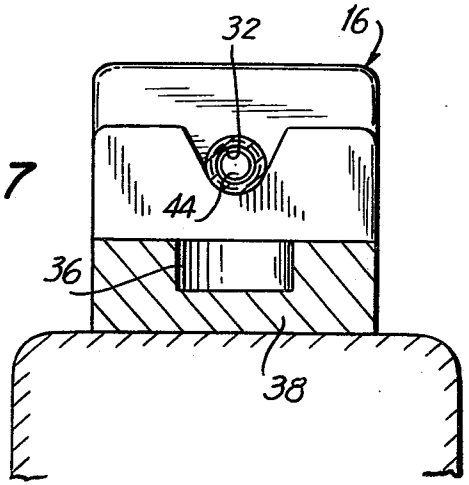
FIG. 7 is a cross-sectional view taken along the line 7—7 of FIG. 5.
Figure 6:
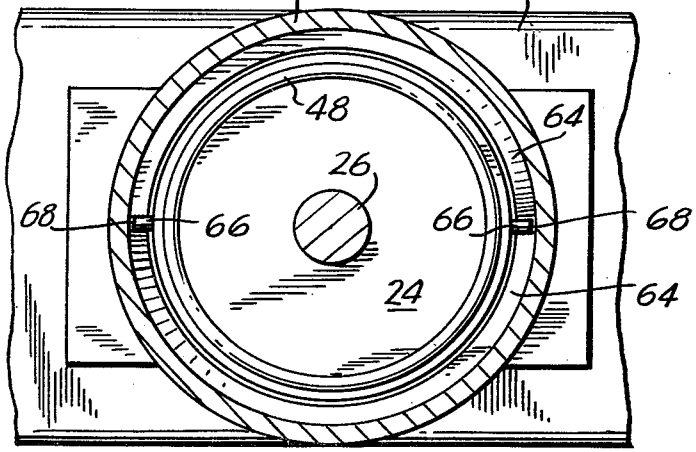
FIG. 6 is a cross-sectional view taken along the line 6—6 of FIG. 5 which shows the means by which the device is activated.

Inadvertent rotation of the grip 28 is prevented by the positioning of the extension 34 in the recess 36. Thus, the only way to activate the device is to lift and then rotate the grip 28. By lifting the grip 28, the extension 34 is lifted with it out from the recess 36 and there is no further resistance to rotation of grip 28. The grip is then rotated 180°. At this point, the grip 28 can be released by the user. By means of a spring 48, the plate 24 and the entire grip 28 are forced back down, thus bringing the end portion 46 of the extension 34 into engagement with the activation nozzle 14 of the pressurized container 12. In this position, as best seen in FIG. 5, the distal end 42 of the channel 32 is in alignment with the opening 44 of the resonance cavity 40.

Thus, the compressed gas can travel from the pressurized container 12, around the end portion 46 of extension 34 and through the internal channel 32 to the resonance cavity 40. Provided in the resonance cavity 40 is a flutter valve 50. This flutter valve 50 should be rotatably positioned inside the resonance cavity 40. One way to do this is to provide shaft portions 52 on the flutter valve 50. These shaft portions 52 can be fitted in appropriate recesses in the resonance cavity 40. The flutter valve 50 comprises three basic portions, namely: a plate portion 54, a contour portion 56 and a wedge portion 58. The plate portion 54 should extend further from the shaft portions 52 than do the other portions so that only the plate portion 54 cooperates with stops 60 and 62 positioned 90 degrees apart within the resonance cavity 40.

Figure 4:
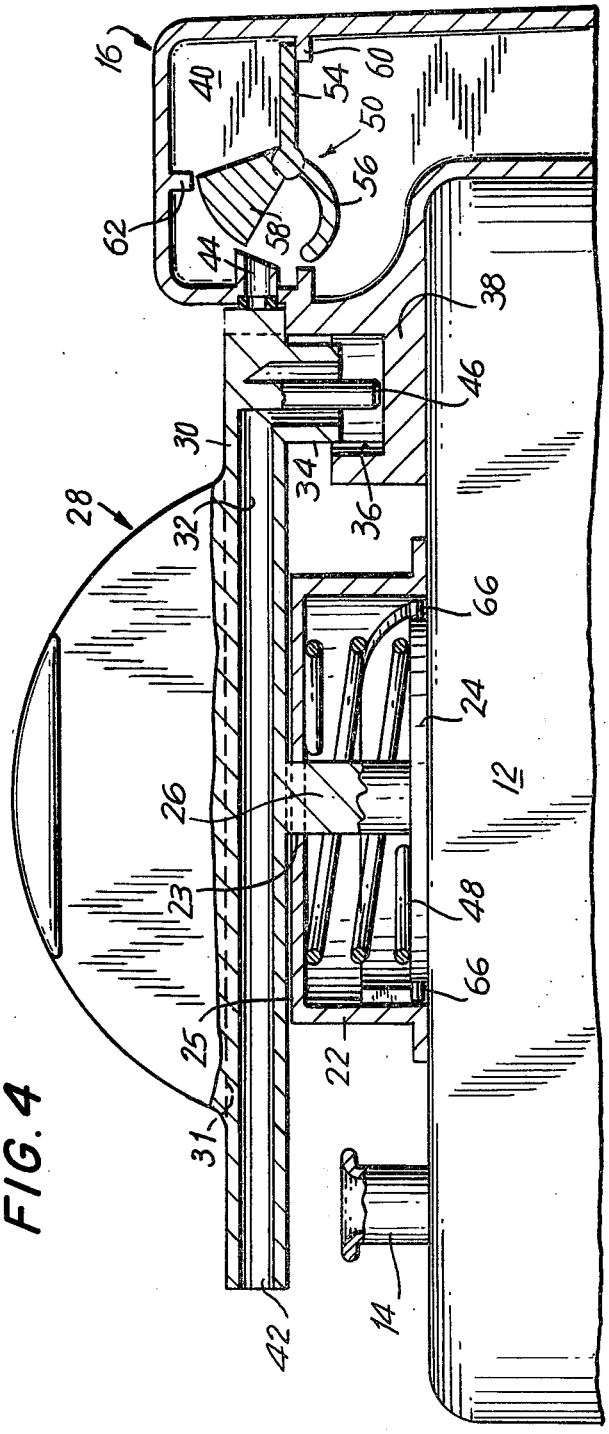
FIG. 4 is an enlarged fragmentary, elevational view, partly in section, of the upper portion of the device in a non-functioning condition.

In operation the plate portion 54 is initially positioned against the stop 60 (see FIG. 4). In this position, the contour portion 56 is facing the opening 44 by which compressed gas is introduced into the resonance cavity 40. Upon entry of the gas into the cavity the force of the incoming gas moves the contour portion 56 downward. This motion causes the plate portion 54 to move upward until it rests against the stop 62 (as best seen in FIG. 5). The gas which caused the contour portion 56 to move is thus diverted through the resonant chamber 18. Because of the design of the chamber 18 and the cavity 40, a noise or siren sound will be made by the onrushing gas. This sound will be emitted through the trumpet portion 20 so that other firemen can hear the alarm.

In the position where the plate 54 is against the stop 62, the wedge portion 58 prevents the onrushing gas from moving downward. Thus, at this point there is no sound emitted from the device. However, the gas will then blow against the plate portion 54, thus moving the plate portion 54 back to its initial position, against the stop 60, ready to be again moved and to facilitate the emission of another noise or siren-like sound. Thus, the alarm will continually operate to generate intermittent horn or siren sounds.

In the preferred embodiment of the alarm a pair of cams 64 are included within the housing 22. The purpose of these cams is to eliminate the need for the user to have to lift the grip 28 to activate the alarm. Rather, upon the rotation of the grip 28 and, consequently, the plate 24, the protruding studs 66 affixed 180° apart to the peripheral edge of the plate 24 ride up on respective cam surfaces. Thus, by means of the cams, the plate 24 and, consequently, the entire grip 28 is raised as the grip is rotated. After traveling along a raised portion of the cams 60, the studs 66 of the plate 24 drop off the end of the cams into the notches 68 on the inside surface of the housing 22. In this position, the ends of the plate are locked into position and the device is activated. To disengage the alarm, one simply rotates the grip an additional 180°.

If a sufficiently distinguishable noise is generated by the resonant chamber 18, the alarm can sound continuously instead of sounding intermittently. Because of the readily distinguishable noise, an intermittent noise will not be necessary to alert fellow firemen of the predicament of the user of the device. To effect such a device, one merely removes the flutter valve from the above-described device. All other components of the device would operate precisely as they do in the above-described device.

I claim:

1. A danger alarm device comprising:

a container of pressurized gas having an activation nozzle on a top portion thereof;

a resonant chamber associated with said container and having a resonance cavity selectively connectable to said activation nozzle, and a sound emitting portion;

a longitudinally extending shaft having an internal channel and rotatably mounted on said top portion of said container, said internal channel having a right-angle extension on a first end, said first end of said channel communicating with said activation nozzle when said alarm is operational, a second end of said channel communicating with said resonance cavity when said alarm is operational;

means for resiliently urging said shaft toward said top portion of said container; and means for securely holding said shaft when said alarm is not operational.

2. A danger alarm device according to claim 1, further comprising:

a flutter valve rotatably mounted in said resonance cavity for rotation between first and second stops when said alarm is operational to create an intermittent sound.

3. A danger alarm according to claim 1, further comprising, means for attaching said alarm to a user.

4. A danger alarm according to claim 1, further comprising a grip attached to said shaft.

5. A danger alarm according to claim 2, further comprising a grip attached to said shaft.

6. A danger alarm according to claim 2, wherein said means for securely holding said shaft includes recess means on said top portion of said container in which said first end of said channel is held when said alarm is not operational.

7. A danger alarm according to claim 2, wherein said means for resiliently urging includes a housing positioned on said top portion of said container; a plate positioned in said housing; a rod extending through a central opening in a top portion of said housing and connecting said shaft and said plate; and spring means positioned coaxially with said rod and in said housing.

8. A danger alarm according to claim 7, further comprising cams positioned in said housing, protruding studs on each end of said plate passing over respective cam surfaces as said shaft is rotated to activate said alarm.

9. A danger alarm according to claim 8, wherein said means for securely holding includes a recess means on said top part of said container in which said first end of said channel is held when said alarm is not operational.

10. A danger alarm device comprising:

a container of pressurized gas having an activation nozzle on a top portion thereof;

a resonant chamber associated with said container and having a resonance cavity selectively connectable to said activation nozzle, and a sound emitting portion;

a longitudinally extending shaft having an internal channel and rotatably mounted on said top portion of said container, said internal channel having a right-angle extension on a first end, said first end of said channel communicating with said activation nozzle when said alarm is operational, a second end of said channel communicating with said resonance cavity when said alarm is operational;

means for selectively securing said hollow shaft in an inoperative position and in an operative position in communication with said activation nozzle.

* * * * *